United States Patent [19]

Selivansky et al.

[11] Patent Number: 4,596,742

[45] Date of Patent: Jun. 24, 1986

[54] PARTIALLY ORIENTED NYLON YARN AND PROCESS

[75] Inventors: Dror Selivansky; John H. Southern, both of Pensacola, Fla.

[73] Assignee: Monsanto Company, St. Louis, Mo.

[21] Appl. No.: 725,693

[22] Filed: Apr. 22, 1985

[51] Int. Cl.[4] ..... D02G 3/00

[52] U.S. Cl. ..... 428/373; 57/243; 428/370; 428/372

[58] Field of Search ..... 428/373, 374, 372, 375, 428/370; 525/420; 528/335, 342; 264/210.8, 211, 177 F; 57/243

[56] References Cited

U.S. PATENT DOCUMENTS

| | | | |
|---|---|---|---|
| 2,708,617 | 5/1955 | Magat et al. | 528/342 X |
| 2,863,857 | 12/1958 | Costain et al. | 528/342 X |
| 3,304,289 | 2/1967 | Ballentine et al. | 528/342 |
| 3,536,802 | 10/1970 | Uraya et al. | 264/171 |
| 3,549,601 | 12/1970 | Fowell | 528/342 X |
| 3,589,956 | 6/1971 | Kranz et al. . | |
| 3,687,904 | 8/1972 | Middleton | 528/342 X |
| 3,994,121 | 11/1976 | Adams | 528/335 |
| 4,093,147 | 6/1978 | Bromley et al. | 428/397 X |
| 4,123,492 | 10/1978 | McNamara et al. | 264/210.5 |
| 4,181,697 | 1/1980 | Koschinek et al. | 264/176 F |
| 4,424,257 | 1/1984 | Bach | 428/370 |
| 4,446,299 | 5/1984 | Koschinek et al. | 264/176 |
| 4,521,484 | 6/1985 | Li | 428/370 |

*Primary Examiner*—Lorraine T. Kendell

*Attorney, Agent, or Firm*—Thomas N. Wallin

[57] ABSTRACT

In a partially oriented nylon feed yarn for drawtexturing, the filaments have sheaths containing a branching agent while the cores do not. Exceptional crimp development is achieved in the resulting textured yarn.

13 Claims, 2 Drawing Figures

PARTIALLY ORIENTED NYLON YARN AND PROCESS

As used in the specification and claims, the term "nylon 66" shall mean those synthetic linear polyamides containing in the polymer molecule at least 85% by weight of recurring structural units of the formula

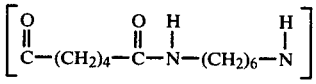

Historically, certain nylon 66 apparel yarns were spun at low speeds of up to about 1400 meters per minute and packaged. The spun yarns were then drawn on a second machine and packaged again. The drawn yarn was then false-twist textured at slow speeds of the order of 55–230 meters per minute by the pin-twist method, yielding a very high quality stretch yarn suitable for stretch garments such as leotards. An exemplary false-twisting element for the pin-twist texturing process is disclosed in Raschle U.S. Pat. No. 3,475,895.

More recently, various other types of false-twisting apparatus have come into commercial use, and are collectively referred to as "friction-twist". Some of the most widely used of these include a disc aggregate of the general type illustrated in Yu U.S. Pat. Nos. 3,973,383, Fishback 4,012,896 or Schuster 3,885,378. Friction-twisting permits considerably higher texturing speeds than pin-twisting, with yarn speeds currently at about 700–900 mpm. Such high texturing speeds are more economical than those attained by the pin-twist process.

Along with the shift to friction-twisting has come a shift to partially-oriented nylon 66 (PON) yarns as the feeder yarns for the friction-twist process. In the conventional PON spinning process, the winding speed is merely increased from the previous standard of about 900–1500 meters per minute to speeds generally in the 2750–4000 meters per minute range, resulting in a PON yarn. PON yarn performs better in the high speed friction-twist texturing process than either the earlier drawn yarn or the low-speed spun yarn mentioned above. However, heretofore yarns textured by the friction-twist process were of distinctly lower quality in terms of crimp development than yarns textured by the pin-twist process. The apparel nylon 66 false-twist textured yarn market is accordingly in essentially two distinct segments: the older, expensive, high quality pin-twist yarns, and the newer, less costly, lower quality friction-twist yarns.

PON feeder yarns for false-twist texturing have had RV's in the range from the middle or upper thirties to the low forties, as indicated by U.S. Pat. No. 3,994,121. Such yarns have more than adequate tenacity for conventional apparel end uses. With conventional nylon 66 polymerization techniques, increasing the polymer RV is expensive and leads to increased rates of gel formation, with consequent shortening of spinning pack (filter) life. High RV polymer is therefore ordinarily not used unless required for some special purpose, such as when high yarn tenacity is required.

It has recently been discovered that high RV PON feeder yarns permit manufacture of friction-twist yarns having increased crimp development, in some cases comparable to that of pin-twist yarns. This increased crimp development provides a substantial increase in fabric covering power as compared to fabrics made from friction-twist yarns made from PON feeder yarns as disclosed by Adams U.S. Pat. No. 3,994,121. Accordingly, less textured yarn is required to provide a fabric of equivalent covering power. Increased productivity in spinning and texturing is also provided by high RV PON yarns.

According to the present invention, a further and substantial improvement in the art is provided by a novel PON feeder yarn, permitting formation of a friction-twist textured yarn having in some cases markedly higher crimp development than even some pin-twist yarns. This permits either or both of increased stretching capability in a fabric of equivalent covering power.

The yarns of the invention are, broadly, false-twist texturing feed yarns spun at high speeds and characterized by a sheath-core conjugate structure, with the sheaths formed from nylon 66 polymer containing a higher amount of branching agent than the polymer forming the cores. The mechanism or precise reason for the improved results of the present invention are not entirely understood.

According to a first principal aspect of the invention there is provided an apparel yarn having an elongation between 45% and 150% and comprising a filament spun at a spinning speed of at leat 2000 MPM, the filament having a nylon 66 sheath component surrounding a core component, the sheath component containing a larger amount of branching agent than the core component.

Accordingly to a second principal aspect of the invention there is provided a process for spinning a sheath-core filament, comprising generating a molten stream comprising a nylon 66 sheath component containing a given quantity of branching agent and core component containing a lower quantity of branching agent (preferably none) than the sheath component, extruding the stream through a spinneret capillary, quenching the stream into a filament, and withdrawing the filament at a spinning speed of at least 2000 MPM.

According to a third principal aspect of the invention there is provided a process for producing a textured yarn, comprising friction-twist texturing a yarn having an elongation between 45% and 150%, the yarn comprising a filament spun at a spinning speed of at least 2000 MPM, the filament having a nylon 66 sheath component surrounding a core component, the sheath component containing a larger effective amount of branching agent than the core component.

According to any of the above principal aspects of the invention, the core component is also preferably nylon 66, and if the yarn is to be used as a feed yarn for false-twist texturing, the branching agent preferably constitutes between 0.01 and 1 (optimally between 0.05 and 0.15) mole percent of the sheath component. The sheath component preferably comprises less than 50% (optimally between 10% and 40%) by weight of the filament. For best results the spinning speed is selected such that the yarn has an elongation lower than 100%, with optimum results achieved when the elongation is between 60% and 90%. The preferred branching agents are trifunctional amines, such as TAN or BHMT, or trifunctional acids, such as trimesic acid.

Other aspects of the invention will in part appear hereinafter and will in part be obvious from the following detailed description taken together with the accompanying drawing, wherein:

FIG. 1 is a schematic front elevation of an exemplary apparatus for spinning the yarns of the invention; and FIG. 2 is a cross-section of an exemplary filament according to the invention.

As shown in FIG. 1, molten polymer streams 20 are extruded through capillaries in spinneret 22 downwardly into quench zone 24 supplied with transversely directed quenching air at room temperature. Streams 20 solidify into filaments 26 at some distance below the spinneret within the quench zone. Filaments 26 are converged to form yarn 28 and pass through interfloor conditioner tube 30. A conventional spin-finish is applied to yarn 28 by finish roll 32. Yarn 28 next passes in partial wraps about godets 34 and 36 and is wound on package 38. The filaments may be entangled as desired, as by pneumatic tangle chamber 40.

Ordinarilly, godets 34 and 36 perform the functions of withdrawing filaments 26 from streams 20 at a spinning speed determined by the peripheral speed of godet 34, and of reducing the tension in yard 28 from the rather high level just prior to godet 34 to an acceptable level for winding onto package 38. Winding tensions within the range of 0.03 to 0.25 grams per denier are preferred, with tensions of about 0.1 grams per denier being particularly preferred. Godets 34 and 36 may be dispensed with if the yarn winding tension immediately prior to the winder in the absence of the godets is within the yarn tension ranges indicated in this paragraph. "Winding tension" as used herein means the yarn tension as measured just prior to the yarn traversing and winding mechanism. Some commercially available winders include an auxiliary roll designed to both assist in yarn traversing and to permit reducing the yarn tension as the yarn is wound onto the bobbin or package. Such winders may be of assistance when using the upper portions of the yarn tension ranges indicated in this paragraph.

DESCRIPTION OF THE PRIOR ART

Example 1

This is an example within the range of present conventional practice. Nylon 66 polymer having an RV of 39 is extruded through a conventional spinning pack and spinneret at a melt temperature of 385° C. Spinneret 22 contains 34 capillaries having lengths of 0.012" (0.3 mm.) and diameters of 0.009" (0.229 mm.) Quench zone 24 is 35 inches in height, and is supplied with 20° C. quench air having an average horizontal velocity of 1 foot (30.5 cm.) per second. Filaments 26 are converged into yarn 28 approximately 36 inches (91.4 cm.) below the spinneret. Conditioner tube 30 is 72 inches (183 cm.) long and is of the type disclosed in Koschinek U.S. Pat. No. 4,181,697, i.e., a steamless tube heated to 120° C. through which yarn 28 passes. The speed of godets 34 and 36 are 4100 meters per minute and 4140 meters per minute, respectively, to prevent the yarn from wrapping on godet 36. The polymer metering rate is selected such that the yarn wound has a denier of 89. The winder used is the Toray 601, and the winder speed is adjusted to provide a winding tension of 0.1 grams per denier. The yarn has an elongation-to-break of 68%, and an RV of 41.

The spun yarn is then simultaneously drawn and friction-twist textured on a Barmag FK6-L900 texturing machine using a 2½ meter primary heater and a Barmag disc-aggregate with Kyocera ceramic discs in a draw zone between a feed and a draw or mid roll. The heater temperature is 225° C., and the ratio of the peripheral speed of the discs to draw roll speed (the D/Y ratio is 1.95. The draw roll speed is set at 750 meters per minute, and the feed roll speed is adjusted to some lower speed to control the draw ratio and hence the draw-texturing tension (the yarn tension between the exit of the heater and the aggregate). In order to maximize the crimp development, the draw ratio is changed by adjustment of the feed roll speed so that the draw-texturing tension is high enough for stability in the false twist zone and yet low enough that the filaments are not broken, this being the operable texturing tension range. Within the operable tension range, the "maximum texturing tension" is defined as the tension producing the maximum initial crimp development without an unacceptable level of broken filaments (frays). More than 10 broken filaments per kilogram are unacceptable in commercial use.

With the Example 1 yarn, the operable texturing tension range is quite narrow when draw-texturing at 750 meters per minute. The maximum texturing tension is found to be about 0.43 grams per draw roll denier, and the aged crimp development is about 15%. The draw roll denier is defined as the spun yarn denier divided by the mechanical draw ratio provided by the different surface speeds of the feed roll feeding the yarn to the heater and of the draw or mid roll just downstream of the false-twist device. When the texturing tension is more than 0.45 grams per draw roll denier, an unacceptable level of broken filaments is produced. The textured yarn has a nominal denier of 70.

If the broken filaments are ignored and texturing tension is increased beyond 0.43 grams per draw roll denier, crimp development increases somewhat at a tension of about 0.44 grams per draw roll denier. However such yarns are not commercially acceptable due to the number of broken filaments (frays). With the spun yarn of this example, an attempt to increase crimp development by increase in heater temperature much above 225° C. also leads to an unacceptable level of broken filaments.

Example 2

This is an example of high RV PON yarn. The spinning process of the first paragraph of Example 1 is repeated, except the polymer is selected and dried so that the yarn RV is about 70. The PON yarn denier is 100, and the yarn has an elongation-to-break (elongation) of 88%. When the spun yarn of this paragraph is draw-textured (245° C. heater) at its maximum texturing tension, the textured yarn has an aged crimp development of about 18–19%, which is comparable to the levels achieved by the pin-twist process. Finished fabrics formed from the textured yarn of this example have greater covering power than similar fabrics formed from the textured yarn of Example 1.

Further increases in texturing tension do not appreciably affect the crimp development, but merely result in broken filaments or yarn breaks.

DETAILED DESCRIPTION OF THE INVENTION

Figure 1:
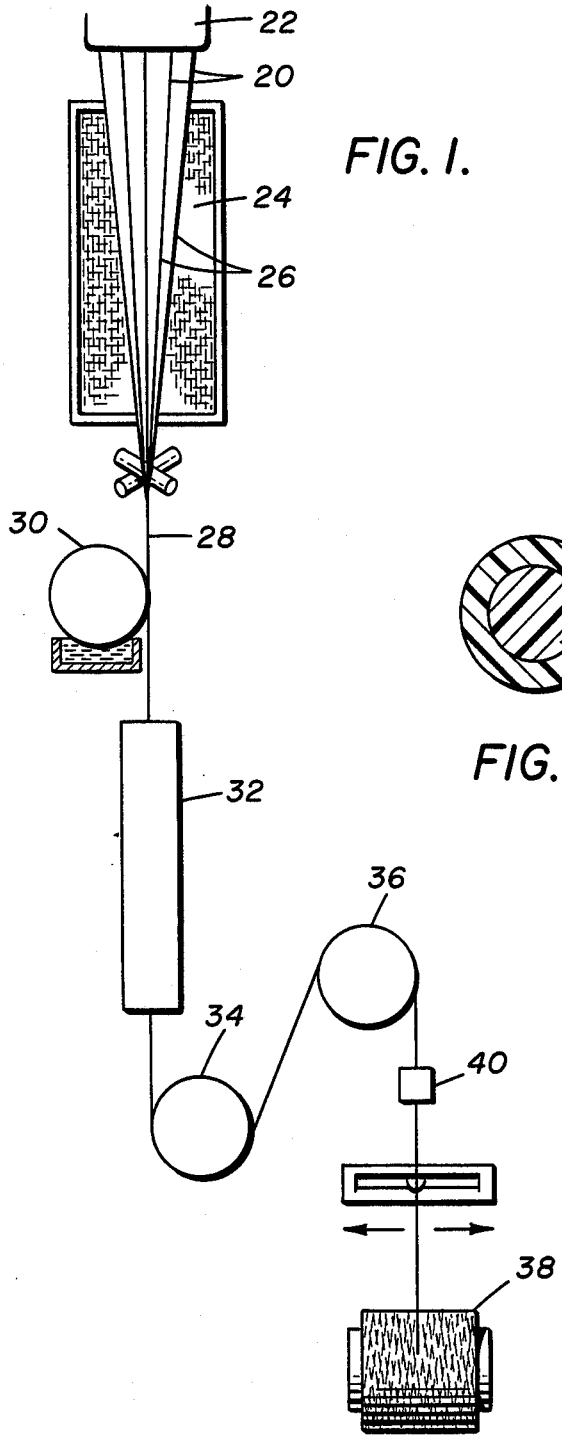
Figure 2:
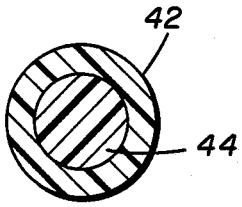

FIG. 2 illustrates the preferred sheath-core filament according to the invention, with sheath 40 surrounding core 42. Spinneret pack designs for forming such sheath-core filaments are well known in the art. According to the invention, sheath 40 is nylon 66 containing a branching agent as more fully disclosed below.

Example 3

This is an example according to the invention. The apparatus described in Example 1 is used except the spinneret pack used in Examples 1 and 2 above is replaced by a spinneret pack designed to produce 34 sheath-core filaments. A first batch of nylon 66 polymer containing 0.34 mol % acetic acid and 0.125 mol % TAN is dried to produce nominal 49 yarn RV, and a second batch of conventional nylon 66 polymer containing 0.34 mol % acetic acid and no chain branching agent is dried to produce nominal 37 yarn RV. The polymers are spun under the conditions set forth in Example 1 above as sheath-core filaments with the polymer containing the TAN forming the sheaths and the second polymer forming the cores. The sheath-core volumetric ratio are 2 to 3. That is, the sheaths constitute 40% of the volume of the filaments, the remaining 60% being the core component. The PON yarn has a denier of 107 and an elongation of 86%, to provide a textured denier of 70.

When the PON yarn is drawtextured by the friction twist method at its maximum texturing tension (225° C. heater), the textured yarn has an aged crimp development of 18.9%. This is substantially greater than the crimp development levels achieved by friction twist texturing of conventional 40 RV PON, and is comparable to the high RV yarn of Example 2 herein.

Example 3 is repeated except the first polymer is further dried to produce nominal 60 RV. The resulting textured yarn has an aged crimp development well above 20%, clearly superior to the Example 2 yarn.

The increased crimp development provides for greater stretch and covering power in fabrics made from the textured yarn of the invention.

The improved results according to the invention are not achieved unless the spinning speed is at least 2200 MPM, with speeds above 3000 MPM being preferred. Spinning speeds above 3400 MPM are particularly advantageous.

While the invention is above exemplified using TAN, numerous other branching agents may be used. BHMT is another example of such an agent with functional groups reactive with the carboxyl groups in nylon 66 polymer, while trimesic acid is an example of an agent with functional groups reactive with the amine groups in nylon 66 polymer. Any necessary adjustment of the amount of branching agent can readily be done by trial and error. Suitable branching agents generally contain three or more functional groups reactive with amine or carboxylic and groups under the conditions used for polymerization the polymer, and generally increase the polymer molecular weight. Alpha-amino-epsilon-caprolactam is noted a another suitable material which has the requisite number of functional groups, some of which react with amines and some which react with carboxyl groups. If the branching agent contains more than three such functional groups, it may be necessary to reduce the level of branching agent significantly below those indicated above as preferred with TAN.

TEST METHODS AND DEFINITIONS

"TAN" is the trifunctional branching agent 4(aminomethyl)-1,8-diaminooctane having the following structural formula:

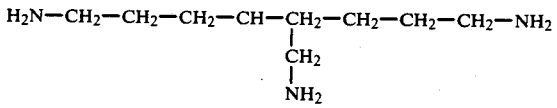

"BHMT" is bis-hexamethylene triamine.

All yarn packages to be tested are conditioned at 21 degrees C. and 65% relative humidity for one day prior to testing.

The yarn elongation-to-break (commonly referred to as "elongation") is measured one week after spinning. Fifty yards of yarn are stripped from the bobbin and discarded. Elongation-to-break is determined using an Instron tensile testing instrument. The gage length (initial length) of yarn sample between clamps on the instrument) is 25 cm., and the crosshead speed is 30 cm. per minute. The yarn is extended until it breaks. Elongation-to-break is defined as the increase in sample length at the time of maximum load or force (stress) applied, expressed as a percentage of the original gage length (25 cm.).

Crimp development is measured as follows. Yarn is wound at a positive tension less than 2 grams on a Suter denier reel or equivalent to provide a $1\frac{1}{8}$ meter circumference skein. The number of reel revolutions is determined by 2840/yarn denier, to the nearest revolution. This provides a skein of approximately 5680 skein denier and an initial skein length of 9/16 meter. A 14.2 gram weight or load is suspended from the skein, and the loaded skein is placed in a forced-air oven maintained at 180° C. for 5 minutes. The skein is then removed from the oven and conditioned for 1 minute at room temperature with the 14.2 gram weight still suspended from the skein, at which time the skein length L2 is measured to the nearest 0.1 cm. The 14.2 gram weight is then replaced with a 650 gram weight. Thirty seconds after the 650 gram weight is applied to the skein, the skein length L3 is measured to the nearest 0.1 cm. Percentage crimp development is defined as $L3-L2/L3\times100$. Crimp development decreases with time as the textured yarn ages on the bobbin, rapidly for the first hours and days, then more slowly. When "initial crimp development" is specified herein, the measurement is made about one day after texturing.

Relative viscosity (RV) is determined by ASTM D789-81, using 90% formic acid.

Broken filaments are determined visually, by counting the number of broken filaments on the exposed surfaces of the packages.

What is claimed is:

1. An apparel yarn having an elongation between 45% and 150% and comprising a filament spun at a spinning speed of at least 2200 MPM, said filament having a nylon 66 sheath component surrounding a core component, said sheath component containing a larger effective amount of branching agent than said core component said branching agent having functional groups reactive with nylon 66 polymer.

2. The yarn defined in claim 1, wherein said core component is nylon 66.

3. The yarn defined in claim 2, wherein said branching agent constitutes between 0.01 and 1 mol percent of said sheath component.

4. The yarn defined in claim 2, wherein branching agent constitutes between 0.05 and 0.15 mol percent of said sheath component.

5. The yarn defined in claim 2, wherein said sheath component comprises less than 50% by weight of said filament.

6. The yarn defined in claim 5, wherein said sheath comprises between 10% and 40% by weight of said filament.

7. The yarn defined in claim 2, wherein said yarn has an elongation lower than 100%.

8. The yarn defined in claim 2, wherein said yarn has an elongation between 60% and 90%.

9. The yarn defined in claim 2, wherein said branching agent comprises a trifunctional amine.

10. The yarn defined in claim 9, wherein said branching agent comprises TAN.

11. The yarn defined in claim 9, wherein said branching agent comprises BHMT.

12. The yarn defined in claim 2, wherein said branching agent comprises a trifunctional acid.

13. The yarn defined in claim 12, wherein said branching agent comprises trimesic acid.

* * * * *